US011486073B2

(12) United States Patent
Choi et al.

(10) Patent No.: US 11,486,073 B2
(45) Date of Patent: Nov. 1, 2022

(54) FRONT-LOADING LAUNDRY-WASHING APPARATUS

(71) Applicant: Samsung Electronics Co., Ltd., Suwon-si (KR)

(72) Inventors: Ho Choi, Suwon-si (KR); Hooijoong Kim, Suwon-si (KR); Jaeik Park, Suwon-si (KR); Eungryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 93 days.

(21) Appl. No.: 16/983,392

(22) Filed: Aug. 3, 2020

(65) Prior Publication Data

US 2021/0040671 A1 Feb. 11, 2021

(30) Foreign Application Priority Data

Aug. 8, 2019 (KR) ..... 10-2019-0096789

(51) Int. Cl.
*D06F 37/06* (2006.01)

(52) U.S. Cl.
CPC ..... *D06F 37/06* (2013.01)

(58) Field of Classification Search
CPC ..... D06F 37/06; D06F 37/22
See application file for complete search history.

(56) References Cited

U.S. PATENT DOCUMENTS

2012/0291302 A1 11/2012 Stegerwald
2018/0112342 A1* 4/2018 Hodgell ..... D06F 37/06

FOREIGN PATENT DOCUMENTS

| | | | | |
|---|---|---|---|---|
| EP | 2053152 | A | * | 4/2009 |
| KR | 20050044157 | A | * | 5/2005 |
| KR | 10-2005-0058742 | A | | 6/2005 |
| KR | 100562549 | B1 | * | 3/2006 |
| KR | 10-2006-0039188 | A | | 5/2006 |
| KR | 10-1047232 | B1 | | 7/2011 |
| KR | 10-1137315 | B1 | | 4/2012 |
| KR | 10-1537610 | B1 | | 7/2015 |

* cited by examiner

*Primary Examiner* — Michael E Barr
*Assistant Examiner* — Pallavi Chitta
(74) *Attorney, Agent, or Firm* — Staas & Halsey LLP

(57) ABSTRACT

A front-loading laundry-washing apparatus includes: a housing including a door in a front thereof for opening and closing; a washing tub rotatably supported inside the housing and shaped like a cylinder opened toward the door to load laundry therein; and a plurality of lifters arranged at predetermined intervals along a spinning direction of the washing tub on an inner circumferential surface of the washing tub, and including end portions extended toward a spinning center of the washing tub, wherein at least one lifter of the plurality of lifters is provided to alternate between a first state having a first height from the inner circumferential surface in a first section within a spinning section of the washing tub and a second state having a second height higher than the first height from the inner circumferential surface in a second section within the spinning section of the washing tub.

12 Claims, 13 Drawing Sheets

FRONT-LOADING LAUNDRY-WASHING APPARATUS

CROSS-REFERENCE TO RELATED THE APPLICATION

This application is based on and claims priority under 35 U.S.C. § 119 to Korean Patent Application No. 10-2019-0096789 filed on Aug. 8, 2019 in the Korean Intellectual Property Office, the disclosure of which is incorporated by reference herein in its entirety.

BACKGROUND

Field

The disclosure relates to a front-loading laundry-washing apparatus having functions of washing or drying laundry, and more particularly to a front-loading laundry-washing apparatus having a structure of a lifter provided inside a drum into which laundry is loaded.

Description of the Related Art

A laundry-washing apparatus refers to an apparatus that includes a washing tub into which laundry such as cloth, clothes, bedclothes, etc. is loaded, and does the laundry in the washing tub by driving the washing tub to spin with a motor. The laundry-washing apparatus may be classified into two of a top-loading and a front-loading according to dispositions of the washing tub. In the top-loading laundry-washing apparatus, the washing tub is substantially vertically disposed and spins with respect to a vertical axis. On the other hand, the washing tub in the front-loading laundry-washing apparatus is disposed substantially horizontally or inclined at a predetermined angle to a horizontal axis. The front-loading laundry-washing apparatus may for example include a drum type (front-loading type) washing machine, and a drum type (front-loading type) drying machine.

To enhance an effect of washing laundry, a front-loading laundry-washing apparatus needs to lift the laundry up inside the washing tub. However, it is not easy for the front-loading laundry-washing apparatus to lift the laundry up from the bottom of the washing tub based on only the spin of the washing tub because a spinning axis of the washing tub is substantially horizontal. Therefore, the front-loading laundry-washing apparatus includes a plurality of lifters which are arranged to be spaced apart from each other on an inner circumferential surface of the washing tub shaped like a drum and protrude toward the rotary axis of the washing tub.

The front-loading drying machine performs a drying process to dry laundry inside the washing tub. The front-loading washing machine may also perform an operation similar to that of the front-loading drying machine in a drying mode. While the washing tub spins, laundry is lifted up by the lifters and falls to the bottom colliding with the inner circumferential surface of the washing tub. In this process, air blows to dry the laundry in the washing tub, and the laundry is dried by air while repetitively going up and down.

However, noise generated while the front-loading drying machine is operating has become a problem. There are two broad causes of noise generated in the front-loading drying machine. One is caused by the air blowing unit or the like mechanism of the front-loading drying machine, and the other one is caused by collision between laundry and the inner circumferential surface of the washing tub in a drying process. In terms of a level of noise, the latter is more at issue than the former.

To reduce such noise, there have been proposed various methods. For example, there are a method of covering the outer circumferential surface of the washing tub with a soundproofing material that prevents noise generated in the washing tub from travelling outward, a method of covering the inner circumferential surface of the washing tub with a shock absorbing material that absorbs shock of laundry, etc. However, the method of covering the outer circumferential surface of the washing tub with the soundproofing material has a limit in reducing noise because a space for installing the soundproofing material is restricted on the outer circumferential surface of the washing tub. Further, in this case, the soundproofing material has a problem of being separable from the washing tub or a problem of increasing material cost. The method of covering the inner circumferential surface of the washing tub with the shock absorbing material has a problem that a zipper or the like metallic object of laundry may abrade or separate the shock absorbing material.

Accordingly, the front-loading laundry-washing apparatus is required to have a simple structure for reducing noise generated in the washing tub without using such a shock absorbing material or soundproofing material.

SUMMARY

According to an embodiment of the disclosure, there is provided a front-loading laundry-washing apparatus including: a housing including a door in a front thereof for opening and closing; a washing tub rotatably supported inside the housing and shaped like a cylinder opened toward the door to load laundry therein; and a plurality of lifters arranged at predetermined intervals along a spinning direction of the washing tub on an inner circumferential surface of the washing tub, and including end portions extended toward a spinning center of the washing tub, wherein at least one lifter of the plurality of lifters is provided to alternate between a first state having a first height from the inner circumferential surface in a first section within a spinning section of the washing tub and a second state having a second height higher than the first height from the inner circumferential surface in a second section within the spinning section of the washing tub.

The first section and the second section may be symmetrical to each other with respect to the spinning center of the washing tub.

The second section may starts before the at least one lifter reaches the highest position in a gravity direction, and the first section may start before the at least one lifter reaches the lowest position in the gravity direction.

The at least one lifter may include: a supporter fastened to the inner circumferential surface of the washing tub; and a mover provided with the end portion of the lifter, movably coupled to the supporter, and alternating between the first state and the second state.

The mover may include: a main body; and a weight including a relatively heavier material than the main body, and provided in a position biased toward the end portion.

The supporter may include a hole therein, and the mover may be movable as inserted in the hole of the supporter.

A lateral side of the hole may be formed with a plurality of guides spaced apart from each other along a spinning axis direction of the washing tub and guiding the mover to move while being in contact with an outer surface of the mover.

A distance between the two guides facing each other to form the hole in an upper end portion of the hole may be smaller than a width of a lower end portion of the mover.

A second end portion opposite to the end portion of the mover may be thicker than the end portion.

The at least one lifter may further include a shock reduction member provided at a side opposite to the end portion of the mover and including an elastic material.

The front-loading laundry-washing apparatus may further include: a driver connected to the mover, and a controller controlling the driver to the mover to move and alternate.

The second height may be 20% to 40% of a diameter of the washing tub.

The second height may be twice the first height.

BRIEF DESCRIPTION OF THE DRAWINGS

The above and/or other aspects will become apparent and more readily appreciated from the following description of embodiments, taken in conjunction with the accompanying drawings, in which.

DETAILED DESCRIPTION OF EMBODIMENTS

Below, embodiments will be described in detail with reference to accompanying drawings. Further, the embodiments described with reference to the accompanying drawings are not exclusive to each other unless otherwise mentioned, and a plurality of embodiments may be selectively combined within one apparatus. The combination of these plural embodiments may be discretionally selected and applied to realize the present inventive concept by a person having an ordinary skill in the art.

In the description of the embodiments, an ordinal number used in terms such as a first element, a second element, etc. is employed for describing variety of elements, and the terms are used for distinguishing between one element and another element. Therefore, the meanings of the elements are not limited by the terms, and the terms are also used just for explaining the corresponding embodiment without limiting the disclosure.

Further, a term "at least one" among a plurality of elements in the disclosure represents not only all the elements but also each one of the elements, which excludes the other elements or all combinations of the elements.

Figure 1:
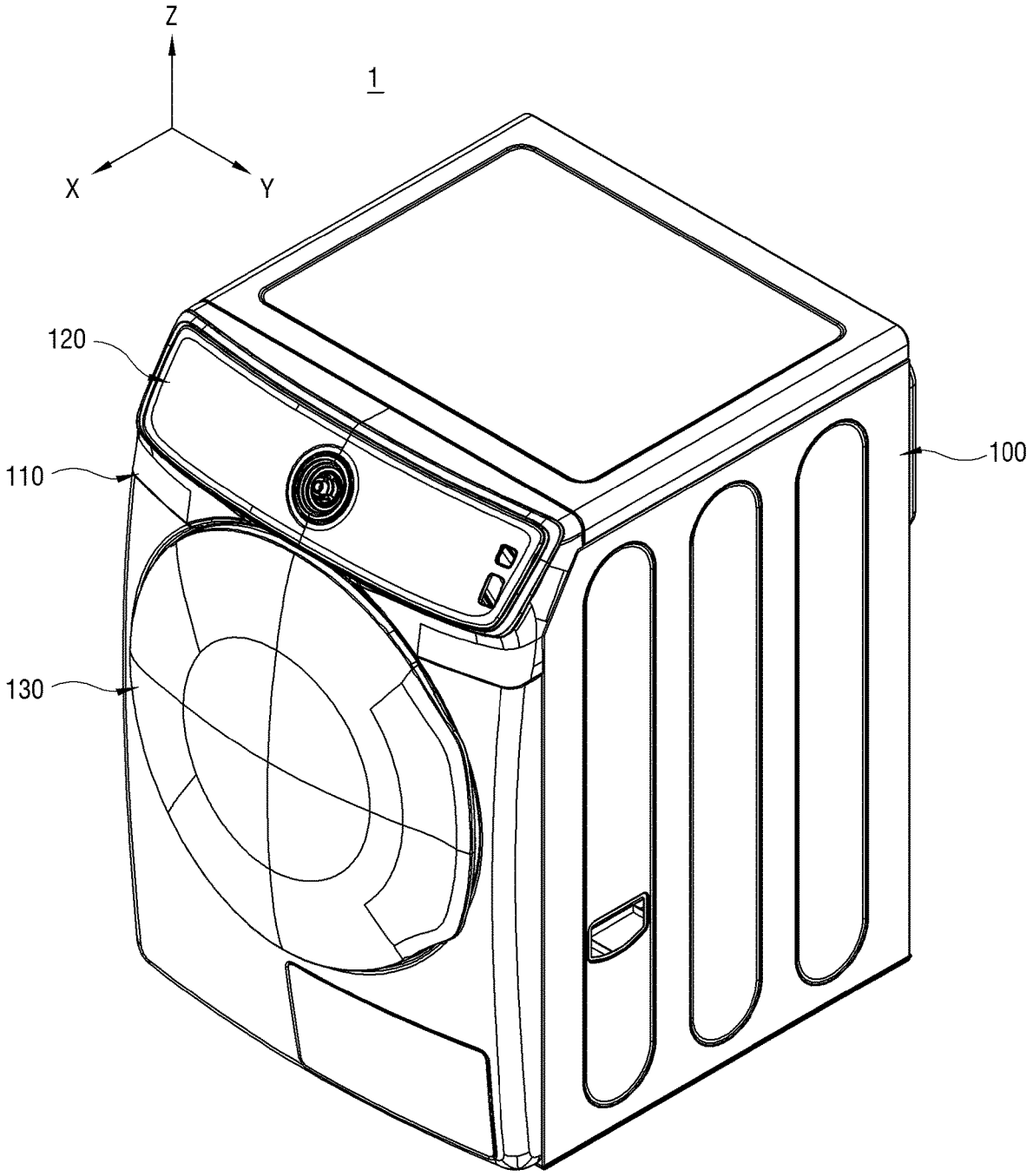
FIG. 1 is an external perspective view of a front-loading drying machine.

FIG. 1 is an external perspective view of a front-loading drying machine.

As shown in FIG. 1, a front-loading laundry-washing apparatus according to an embodiment of the disclosure is embodied by a front-loading drying machine 1. However, the front-loading laundry-washing apparatus is not limited to only the front-loading drying machine 1, but may be embodied by a front-loading washing machine in which washing and drying processes are performed. The front-loading drying machine 1 refers to an apparatus that blows hot air into a drum, in which an object to be dried, for example, laundry is loaded, while the drum is spinning, thereby drying the laundry. Here, the object includes any object, which can be dried by hot air, for example, products made of various kinds of fabric and textile materials like clothes, a towel, etc.

In the accompanying drawings, X, Y and Z directions are orthogonal to one another. The X direction refers to a direction toward the front of the front-loading drying machine 1, in which a user is generally positioned to control the front-loading drying machine 1. The Y direction refers to a widthway direction of the front-loading drying machine 1. The Z direction refers to a vertical direction of the front-loading drying machine 1, which is opposite to the direction of gravity. The following descriptions will be based on these directions.

The front-loading drying machine 1 includes a housing 100 having a rectangular parallelepiped shape prolonged overall in the vertical direction. On the front of the housing 100, i.e. the fore of the housing 100 in the X direction, a front panel 110 is provided. In an upper end portion of the front panel 110, a user interface 120 is provided to allow a user to control operations of the front-loading drying machine 1 and inform the user of operation states of the front-loading drying machine 1. The user interface 120 may for example include a display panel, a touch screen, a mechanical button, an electronic button, and the like interface environments.

In a center region of the front panel 110, a circular opening is formed to allow a user to put laundry into the housing 100 or take the laundry out of the housing 100. The front panel 110 supports a door 130 to be rotated by external force, so that the opening in the center region of the front panel 110 can be opened and closed by the rotation of the door 130.

The front-loading drying machine 1 includes at least one heat source, and blows hot air based on the heat source into the housing 100. The heat source may for example include a heater or a heat pump. When the front-loading drying machine 1 includes the heat pump formed with a refrigerant circuit, the front-loading drying machine 1 may be classified into a circulation type and an exhaust type according to flow of air. In the circulation type front-loading drying machine 1, laundry is dried while air is circulating inside the housing 100 without inhalation or exhalation of air. In the exhaust type front-loading drying machine 1, external air is inhaled into the housing 100 and exhaled to the outside after being used in drying. In this embodiment, both the circulation type and the exhaust type are all applicable to the front-loading drying machine 1.

Figure 2:
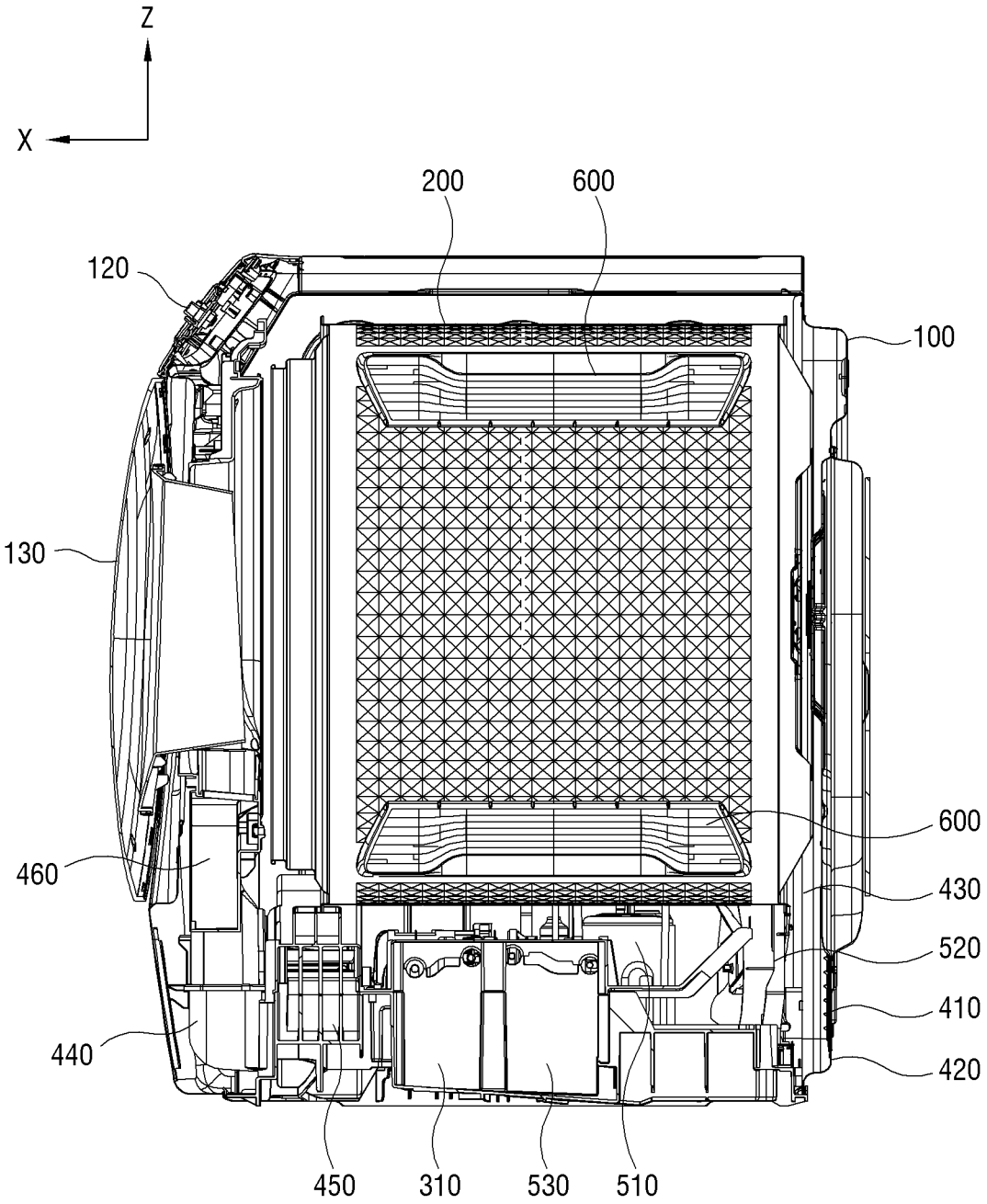
FIG. 2 is a lateral cross-section view of a front-loading drying machine.

FIG. 2 is a lateral cross-section view of a front-loading drying machine.

As shown in FIG. 2, a front-loading drying machine 1 includes a housing 100, a drum 200 provided as a washing tub supported in a housing 100 and spinnable, a driver driving the drum 200 to spin, an air-flow former allowing air for drying to move inside the drum 200, and a heat pump exchanging heat with moving air.

The drum 200 is shaped like a cylinder lying horizontally with the opened front and back. The drum 200 may be disposed in parallel with the axis of the X direction, or may be disposed at a predetermined angle to the axis of the X direction. The drum 200 includes stainless steel or the like metallic material. The front opening of the drum 200 is opened and closed with the door 130, so that laundry can be put into the drum 200 through the front opening. On an inner circumferential surface of the drum 200 into which laundry is loaded, a plurality of lifters 600 is provided protruding to lift and drop the laundry. The details of the lifter 600 will be described later.

The driver includes a motor 310 installed outside the drum 200 at a lower side of the housing 100 and generating driving force, and a belt installed to surround the outer circumferential surface of the drum 200 and transferring the driving force from the motor 310 to the drum 200 so that the drum 200 can spin. When the motor 310 operates in a drying process, the belt connected to the motor 310 is moved contacting the outer circumferential surface of the drum 200, so that the drum 200 can spin with respect to the axis of the X direction.

The air-flow former forms a chain of air flows, in which air outside the housing 100 is inhaled into the drum 200 and air inside the drum 200 is exhaled to the outside of the housing 100. The air-flow former includes an intake port 410 formed in the housing 100 to suck the external air into the housing 100, an exhaust port 420 formed in the housing 100 to discharge air from the inside to the outside of the housing 100, an inhalation duct 430 installed in the housing 100 to guide air sucked through the intake port 410 into the inside of the drum 200, an exhalation duct 440 installed in the housing 100 to guide air inside the drum 200 to the exhaust port 420, a fan unit 450 installed on the exhalation duct 440 to blow air for air circulation, and a filter 460 installed in a certain region of the exhalation duct 440 to filter air to be introduced into the exhalation duct 440.

With this configuration, air outside the housing 100 is introduced into the drum 200 along the inhalation duct 430 through the intake port 410, and used in drying laundry inside the drum 200. Air used in drying the laundry is moved from the drum 200 along the exhalation duct 440, and, in this process, foreign materials from the laundry are collected in the filter 460. Air moving along the exhalation duct 440 is discharged to the outside of the housing 100 along the exhaust port 420. In the drying process, such air flows are repetitively carried out.

The heat pump heats air moving by the air-flow former or exchanges heat with refrigerants, thereby supplying hot and dry air to the inside of the drum 200. The heat pump includes a compressor 510, a condenser 520, an evaporator 530, and an expansion valve for a refrigerant cycle of compression-condensation-expansion-evaporation. Further, a heater may be additionally installed on the inhalation duct 430 to directly heat air. The heater may be embodied by a coil or the like that generates heat based on electric power.

The compressor 510 compresses a refrigerant to have high temperature and high pressure, and discharges the compressed refrigerant to the condenser 520. The compressor 510 may for example compress a refrigerant based on reciprocal movement of a piston or rotary movement of a rotor. The compressor 510 receives a refrigerant having low pressure and outputs a refrigerant having high pressure, thereby urging the refrigerant to move and form the circulation cycle.

The condenser 520 is installed on the inhalation duct 430 and raises the temperature of air introduced into the drum 200 based on heat exchange. The condenser 520 condenses the compressed refrigerant into liquid refrigerant, and emits heat to air in the inhalation duct 430 based on the condensation.

The evaporator 530 is installed on the exhalation duct 440 and lowers the temperature of air discharged from the inside of the drum 200 based on heat exchange. The evaporator 530 evaporates the refrigerant expanded in the expansion valve and absorbs heat from air in the exhalation duct 440, thereby changing the refrigerant into a refrigerant having low temperature and low pressure and then transferring the refrigerant to the compressor 510.

The expansion valve expands the liquid refrigerant condensed in the condenser 520 to have high temperature and high pressure into a liquid refrigerant having low pressure. The expansion valve is provided to control pressure difference of a refrigerant. The expansion valve may include an electronic expansion valve (EEV) of which an opening degree is variable, and control the flow rate of the refrigerant by adjusting the opening degree of the expansion valve based on the control signal.

Below, the structures of the drum 200 and the lifter 600 according to an embodiment of the disclosure will be described.

Figure 3:
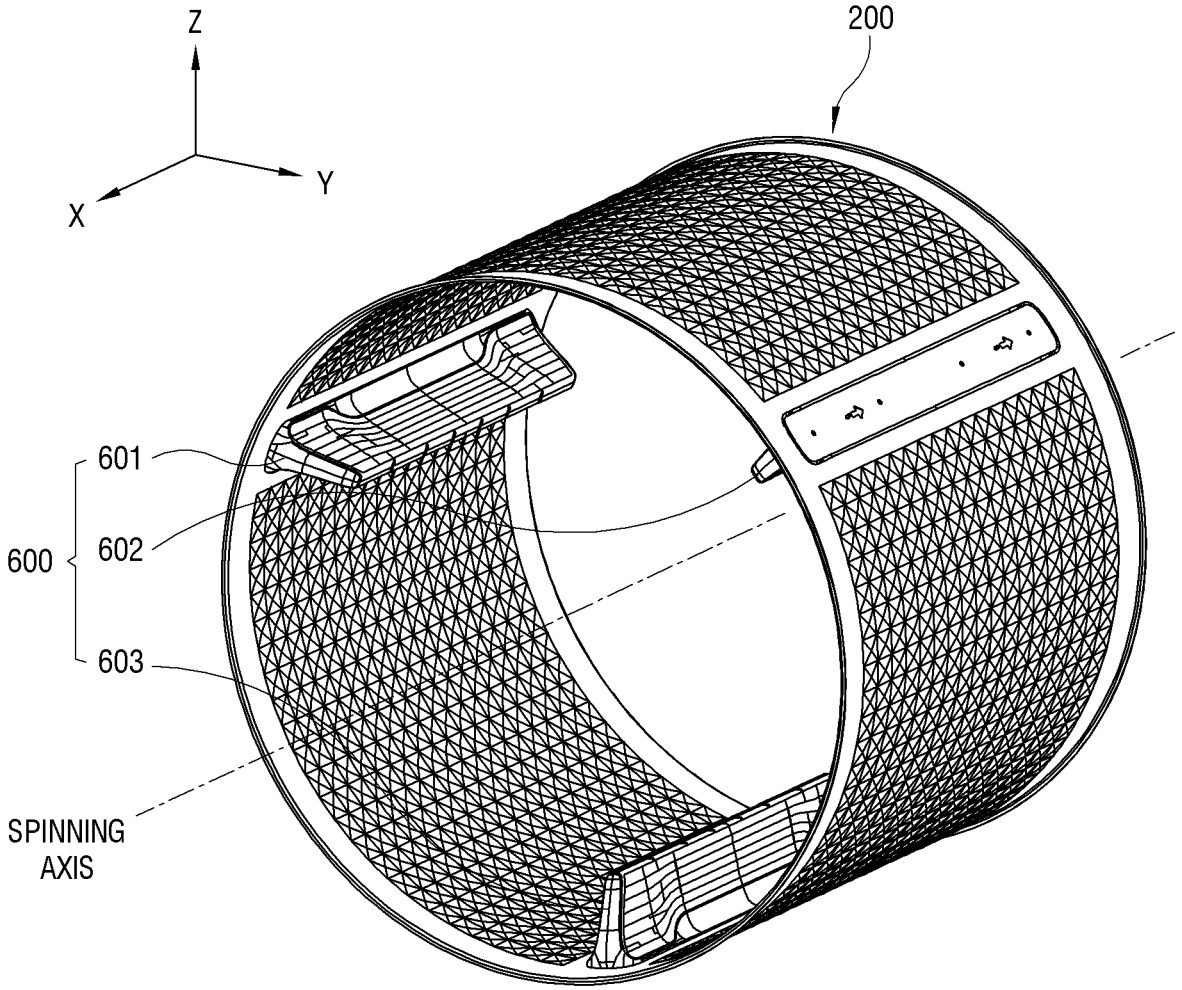
FIG. 3 is a perspective view of a drum with a plurality of lifters in a front-loading drying machine.

FIG. 3 is a perspective view of a drum with a plurality of lifters in a front-loading drying machine.

As shown in FIG. 3, the drum 200 is opened frontward, and spinnable with respect to the axis of the X direction. The plurality of lifters 600 are arranged to be spaced apart from each other along the inner circumferential surface of the drum 200. In this embodiment, it will be described that three lifters 600 of a first lifter 601, a second lifter 602, and a third lifter 603 are provided in the drum 200. However, there are no limits to the number of lifters 600.

When the drum 200 spins, laundry inside the drum 200 is attached to the inner circumferential surface of the drum 200 based on the centrifugal force. In this case, the laundry is lifted up by the side of the lifter 600 and falls because of gravity. While the laundry falls, hot and dry air supplied from the back of the drum 200 passes through the laundry and removes water from the laundry.

The plurality of lifters 600 are symmetrically arranged with respect to a spinning axis of the drum 200. Further, the lifter 600 is extended from the front of the drum 200 to the back of the drum 200 in parallel with the spinning axis of the drum 200. The lifter 600 may be supported on the drum as fastened with a screw or the like to the drum 200 or hooked to a hole formed in the drum 200.

The plurality of lifters 600 is installed to protrude from the inner circumferential surface of the drum 200 toward the spinning axis of the drum 200. The bottom of the lifter 600 is in contact with the inner circumferential surface of the drum 200, and an upper end portion of the lifter 600 is oriented toward the spinning axis of the drum 200. In other words, all the upper end portions of the plurality of lifters 600 are formed to face toward the spinning axis of the drum 200.

In this embodiment, the height of the lifter 600 is not fixed but may be variable between a first height and a second height higher than the first height. Here, the height of the lifter 600 refers to a distance from the bottom contacting the inner circumferential surface of the drum 200 to the upper end portion oriented toward the spinning axis of the drum 200. The height of the lifter 600 is variable depending on the position of the corresponding lifter 600 while the drum 200 is spinning.

The first height and the second height of the lifter 600 may be designed in consideration of various factors such as the capacity, diameter, etc. of the drum 200. For example, the second height is twice the first height, and 20% to 40% of the diameter of the drum 200. However, the first height and the second height of the lifter 600 according to an embodiment of the disclosure are not limited to this example.

Figure 4:
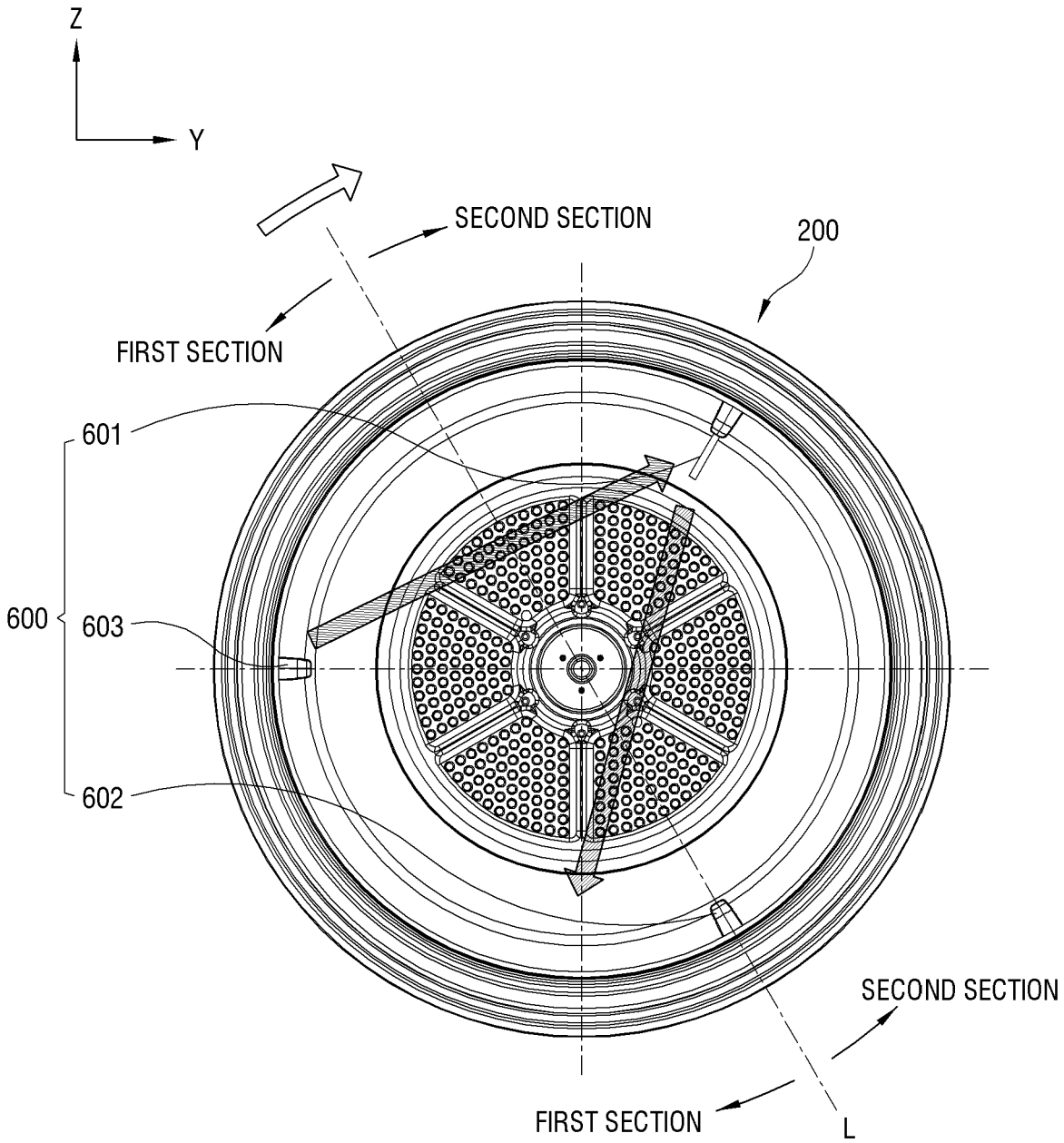
FIG. 4 is a front view of a drum with a plurality of lifters.

FIG. 4 is a front view of a drum with a plurality of lifters.

As shown in FIG. 4, the plurality of lifters 600 are arranged to be equidistantly spaced apart from each other on the inner circumferential surface of the drum 200 when viewed from the front of the drum 200. It may be assumed that the axis of the Z direction crosses the spinning axis of the drum 200 and a straight-line L is clockwise inclined at a predetermined angle to the axis of the Z direction on the drawing. This inclined angle may be set according to design methods.

The straight-line L is positioned between the axis of the −Y direction and the axis of the Z direction which cross the spinning axis, in which an angle between the straight-line L and the axis of the Z direction may be smaller than an angle between the straight-line L and the axis of the −Y direction. For example, when the inner circumference of the drum 200 is divided into twelve sections like a clock, the straight-line L may be set in about eleven and five o'clock directions. However, this is merely an example, and therefore the angle of the straight-line L is not limited to a specific numerical value.

The whole spinning section of the drum 200 with respect to the spinning axis may for example be a clockwise spinning section in a viewpoint of FIG. 4, and divided into a first section and a second section with respect to the straight-line L. In other words, the first section and the second section are symmetrically arranged with respect to the spinning axis of the drum 200. The first section includes the lowest position in the gravity direction of the drum 200, i.e. includes a six o'clock direction. The second section includes the highest position in the gravity direction of the drum 200, i.e. includes a twelve o'clock direction. In other words, the first section starts before the lifter 600 reaches the lowest position in the gravity direction, and the second section starts before the lifter 600 reaches the highest position in the gravity direction.

The lifters 600 alternate between different states in the first section and the second section. The lifter 600 is in a first state having the first height from the inner circumferential surface of the drum 200 within the first section. On the other hand, the lifter 600 is in a second state having the second height higher than the first height from the inner circumferential surface of the drum 200 within the second section. As the drum 200 spins and the position of the lifter 600 repetitively alternates between the first section and the second section, the lifter 600 repetitively alternates between the first state and the second state. Such a structure of the lifter 600 having a variable height may be applied to all or only some of the plurality of lifters 600 provided in the drum 200.

Meanwhile, when the drum 200 clockwise spins with respect to the spinning axis, laundry is lifted up by the lifters 602 and 603 positioned in the first section between about the five o'clock direction and the eleven o'clock direction with respect to the spinning axis. Then, the laundry is pushed and lifted toward the second section between about the eleven o'clock direction and the five o'clock direction with respect to the spinning axis. The pushed and lifted laundry falls to the bottom colliding with the lifter 601 positioned in the second section.

In this case, the lifter 601 positioned in the second section has the second height relatively higher than those of the lifters 602 and 603 positioned in the first section, and therefore the end portion of the lifter 601 is relatively close to the spinning axis of the drum 200. This means that the laundry pushed and lifted up toward the second section is highly likely to collide with not the inner circumferential surface of the drum 200 but the lifter 601.

If the lifter 601 in the second section has the first height, the laundry pushed and lifted up toward the second section is highly likely to collide with the inner circumferential surface of the drum 200. In case of the laundry including a zipper or the like, noise may be generated when the laundry collides with the inner circumferential surface of the drum 200. Because the drum 200 includes a metallic material, noise caused by the collision with the drum 200 may echo all around the drum 200 and become louder.

On the other hand, according to an embodiment of the disclosure, the height of the lifter 601 positioned in the second section among the plurality of lifters 600 is relatively raised to increase a chance of collision between the laundry and the lifter 601, thereby reducing the noise caused by the laundry. Because the lifter 600 includes a plastic material, noise caused by the collision with the lifter 600 is relatively reduced as compared with that caused by the collision with the drum 200. Further, the lifter 600 and the drum 200 are not formed as a single body, and therefore the noise generated in the lifter 600 minimally echoes all around the drum 200.

When the lifter 601 moves from the second section to the first section as the drum 200 spins, the height of the lifter 601 is relatively lowered from the second height to the first height.

There are various structures and methods of designing the lifter 600 to have variable height. Below, various embodiments about the structure or method in which the height of the lifter 600 is variable will be described.

Figure 5:
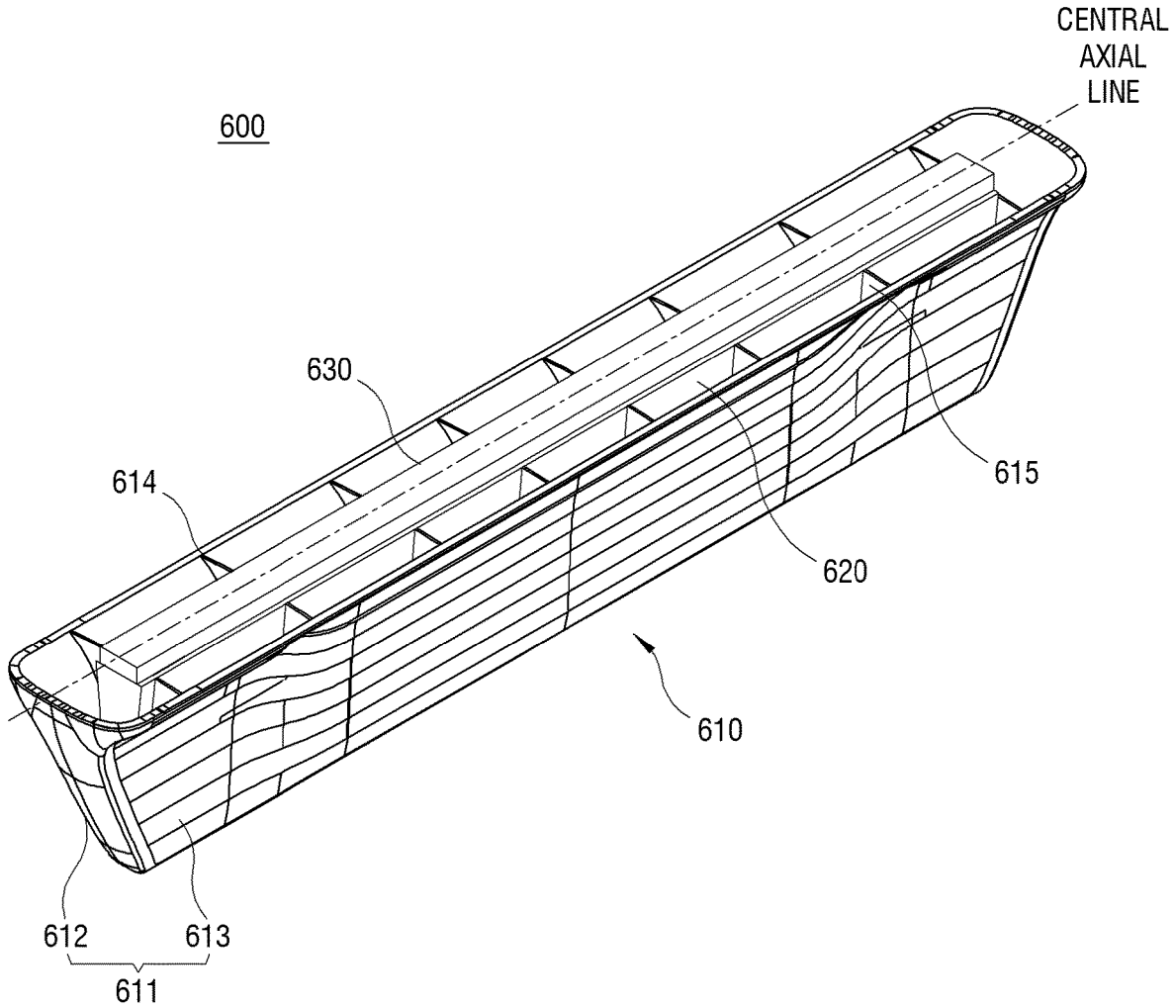
FIG. 5 is a perspective view of a lifter in a first state, viewed from its bottom.

FIG. 5 is a perspective view of a lifter in a first state, viewed from its bottom.

Figure 6:
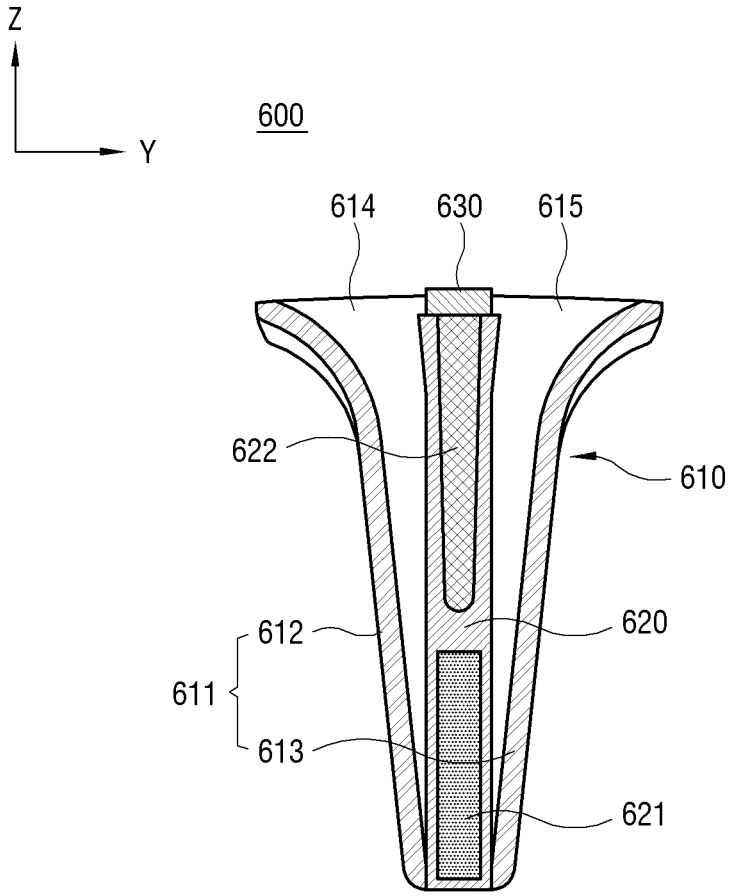
FIG. 6 is a lateral cross-section view of a lifter in a first state.

FIG. 6 is a lateral cross-section view of a lifter in a first state.

As shown in FIGS. 5 and 6, the lifter 600 includes a supporter 610 fastened to the inner circumferential surface of the drum, and a mover 620 movably coupled to the supporter 610 and alternating between the first state and the second state of the lifter 600. In other words, the bottom of the lifter 600 coupled to the drum corresponds to the bottom of the supporter 610. The upper end portion of the lifter 600 facing toward the spinning axis of the drum corresponds to the upper end portion of the mover 620. According to this embodiment, the relative position of the mover 620 to the supporter 610 is variable depending on gravity, so that the lifter 600 can alternate between the first state and the second state.

Below, the structure of the supporter 610 will be described.

The supporter 610 is shaped to taper from the bottom upward. The supporter 610 includes a supporter housing 611 forming an outer appearance of the supporter 610, and a plurality of guides 614 and 615 extended from a first lateral wall 612 and a second lateral wall 613 of the supporter housing 611 toward a central axial line of the lifter 600 and facing with each other. The central axial line of the lifter 600 is in parallel with the spinning axis of the drum. The first lateral wall 612 and the second lateral wall 613 of the supporter housing 611 are arranged at opposite sides of the supporter housing 611 with respect to the central axial line of the supporter housing 611.

Inside the supporter housing 611, an accommodating hole is formed to accommodate the mover 620 to be movable. In the accommodating hole of the supporter housing 611, a plurality of first side guides 614 extended from the first lateral wall 612 and a plurality of second side guides 615 extended from the second lateral wall 613 are provided. The plurality of guides 614 and 615 are spaced apart from each other along the central axial line. The mover 620 is movable alternating between the first state and the second state, with its outer surface being in contact with the front end portions of the plurality of guides 614 and 615. The contact area between the supporter 610 and the mover 620 is relatively decreased by the plurality of guides 614 and 615, so that the mover 620 can be more easily moved.

Further, a distance between the first side guide 614 and the second side guide 615 facing each other at the upper end portion of the supporter 610 is smaller than the width of the lower end portion of the mover 620. Thus, the mover 620 is prevented from being separated from the supporter 610.

Below, the structure of the mover 620 will be described.

The mover 620 is extended in parallel along the lengthwise direction of the supporter housing 611. The cross-section of the mover 620 taken along the Y-Z plane has an overall quadrangular shape. However, the width of the lower end portion of the mover 620 facing toward the inner circumferential surface of the drum is wider than the width of the upper end portion of the mover 620 facing toward the spinning axis of the drum. For example, the cross-section of the mover 620 generally has a rectangular shape, but the lower end portion of the mover 620 protrudes leftward and rightward. Alternatively, the cross-section of the mover 620 may have a trapezoidal shape tapering from the lower end portion toward the upper end portion. Therefore, the mover 620 is prevented from being separated from the supporter 610.

The mover 620 may be divided into a lower region adjacent to the lower end portion, and an upper region adjacent to the upper end portion. In other words, the lower region of the mover 620 includes a region that is always accommodated in the supporter 610 even though the mover 620 moves. The upper region of the mover 620 may be accommodated in the supporter 610 or exposed to the outside of the supporter 610 according to the positions of the mover 620.

The mover 620 may further include a weight 621 in the upper region, in which the weight 621 is made of a material relatively heavier than that of the main body of the mover 620. In other words, the position of the weight 621 may be biased in the upper end portion of the mover 620. Thus, the mover 620 is more easily movable based on gravity. Alternatively, the mover 620 may be designed not to include the weight 621.

Alternatively, the mover 620 may be formed with a lower empty space 622 for reducing weight in the lower region. Because the weight of the mover 620 is biased toward the upper end portion by the lower empty space 622, the lower empty space 622 has an effect similar to that of the weight 621. In this embodiment, both the weight 621 and the lower empty space 622 are applied to the mover 620. However, either/neither of the weight 621 or/nor the lower empty space 622 may be selectively applied according to design methods.

A shock reduction member 630 is provided in the lower end portion of the mover 620. The shock reduction member 630 is thick enough to have contact with the inner circumferential surface of the drum at one side of the shock reduction member 630 when the lifter 600 is in the first state. The shock reduction member 630 includes an elastic material, a shock-absorbing material, a soundproofing material, etc. to thereby absorb or reduce a shock between the mover 620 and the drum. The shock reduction member 630 may include various materials such as rubber. Alternatively, the shock reduction member may be provided in other positions than the lower end position of the mover 620, for example, the inner circumferential surface of the drum, etc.

With this structure, when the lifter 600 is in the first section, gravity acts in a direction from the upper end portion of the lifter 600 toward the lower end portion. The mover 620 is accommodated in the supporter 610 by gravity, and the lower end portion of the mover 620 described in the embodiment shown in FIG. 6, in particular, the shock reduction member 630 is in contact with the inner circumferential surface of the drum. During this, the height of the lifter 600 is the first height.

Below, the structure of when the height of the lifter 600 is raised up to the second height will be described.

Figure 7:
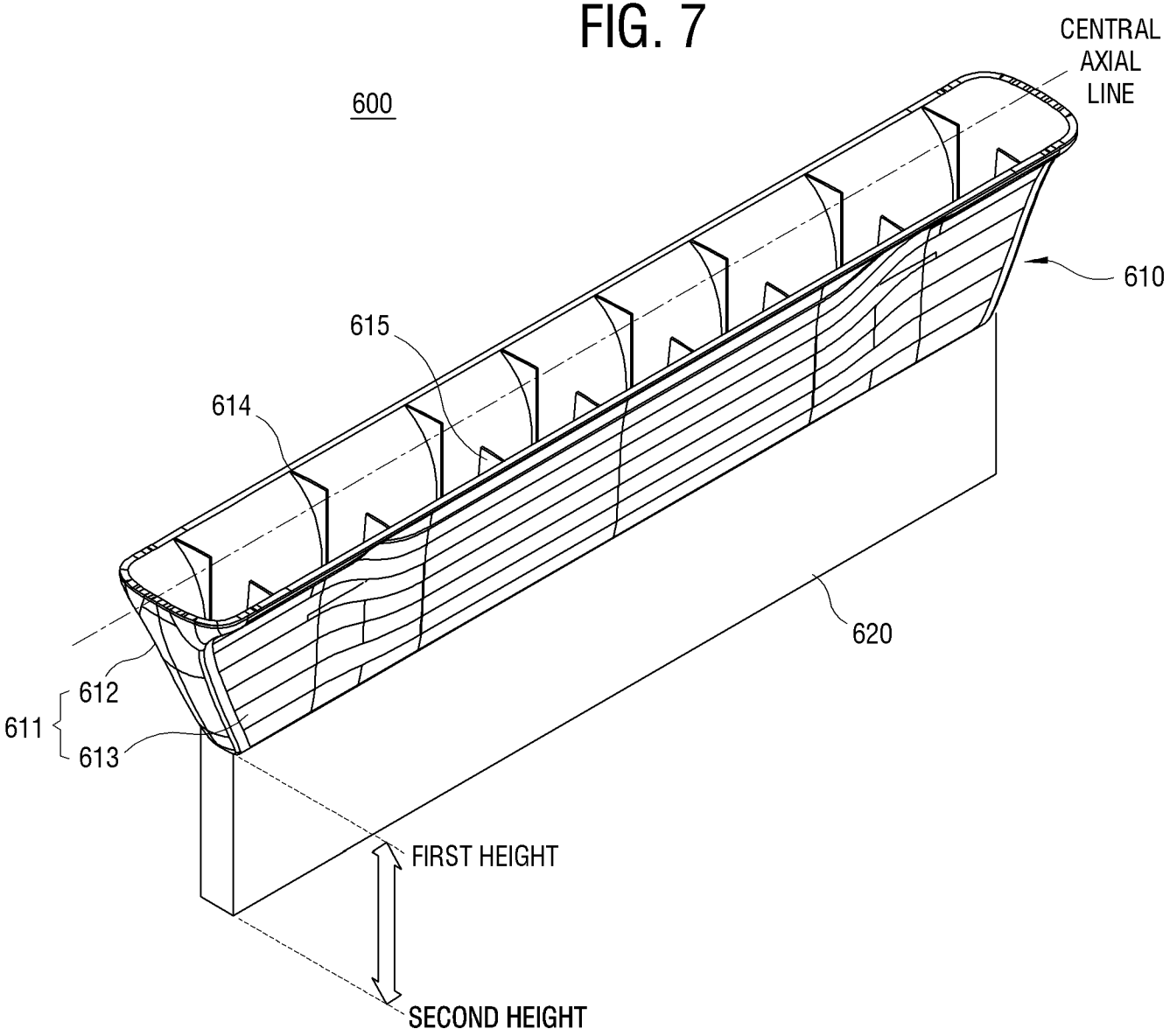
FIG. 7 is a perspective view of a lifter in a second state, viewed from its bottom.

FIG. 7 is a perspective view of a lifter in a second state, viewed from its bottom.

Figure 8:
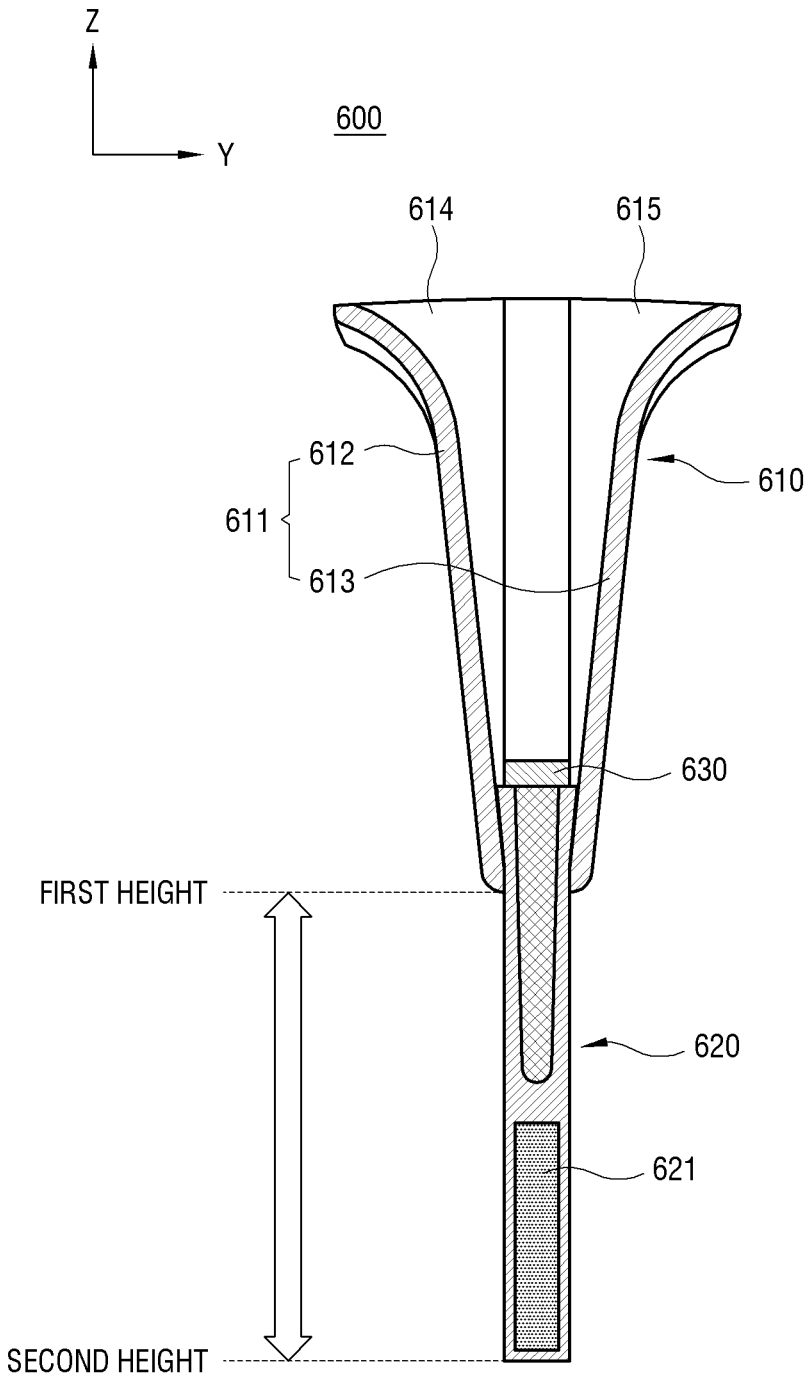
FIG. 8 is a lateral cross-section view of a lifter in a second state.

FIG. 8 is a lateral cross-section view of a lifter in a second state.

As shown in FIGS. 7 and 8, when the lifter 600 is moved from the first section to the second section, gravity acts in a direction from the lower end portion of the lifter 600 toward the upper end portion. The mover 620 moves from the accommodating hole 616 inside the supporter 610 to the outside, and the upper end portion of the mover 620 moves from the position of the first height to the position of the second height. Thus, the height of the whole lifter 600 is raised from the first height up to the second height. Due to the weight 621 provided in the upper region of the mover 62, the mover 620 is more easily movable by gravity.

When the upper end portion of the mover 620 reaches the position of the second height, the mover 620 does not move any more even though gravity continuously acts. This is because the lower end portion of the mover 620 is caught by the upper end portion of the supporter 610 so that the mover 620 can be prevented from being separated from the supporter 610.

The distance between the first side guide 614 and the second side guide 615 inside the accommodating hole 616 is gradually decreased toward the upper end portion of the supporter 61, forming a tapering shape. In other words, the distance between the first side guide 614 and the second side guide 615 facing each other at the upper end portion of the supporter 610 needs to be smaller than the width of the lower end portion of the mover 620. Therefore, the mover 620 is prevented from being completely separated from the supporter 610 even though the mover 620 moves from the supporter 610 downward in the −Z direction by gravity.

Like this, the lifter 600 is stretched out from the first height to the second height in the second section, and therefore increased in an area for collision with the laundry lifted up by another lifter. When the lifter 600 enters the first section, the mover 620 is accommodated in the supporter 610 by gravity, and the lifter 600 is shortened from the second height to the first height.

In this embodiment, the mover 620 is accommodated in the accommodating hole 616 of the supporter 610 or partially stretched out of the accommodating hole 616, thereby changing the height of the lifter 600. However, the structure for the variable height of the lifter 600 is not limited to this embodiment, but may be variously embodied according to workshop modifications. Such an embodiment will be described below.

Figure 9:
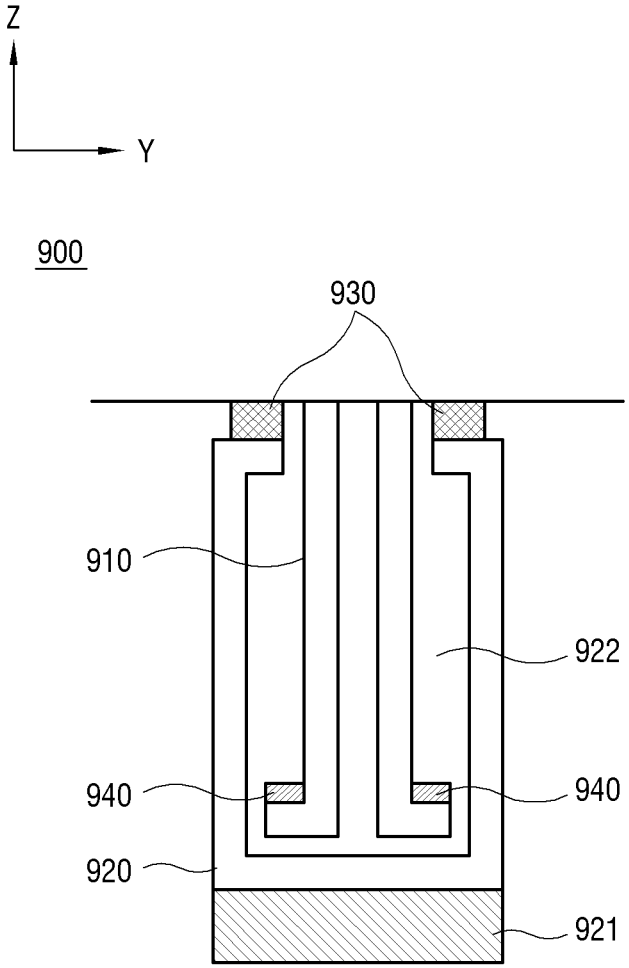
FIG. 9 is a lateral cross-section view of a lifter in a first state.

FIG. 9 is a lateral cross-section view of a lifter in a first state.

As shown in FIG. 9, a lifter 900 includes a supporter 910 coupled to the inner circumferential surface of the drum, and a mover 920 supported on the supporter 910 and relatively movable with respect to the supporter 910. This embodiment is the same as the foregoing embodiment in that the lifter 900 alternates between the first height and the second height as the mover 920 is moved with respect to the stationary supporter 910. However, unlike the foregoing embodiment, the mover 920 of the lifter 900 in this embodiment further includes an accommodating hole 922 to accommodate the supporter 910.

The lower end portion of the supporter 910 is coupled to the inner circumferential surface of the drum, and the upper end portion of the supporter 910 is accommodated in the accommodating hole 922 of the mover 920. Here, the width of the upper end portion of the supporter 910 is larger than the width of the lower end portion of the accommodating hole 922, thereby preventing the mover 920 from being completely separated from the supporter 910.

The mover 920 is shaped like a cylinder or a polygonal prism to surround the supporter 910. The mover 920 includes the accommodating hole 922 to accommodate the supporter 910. The accommodating hole 922 is extended from the bottom of the mover 920 facing the inner circumferential surface of the drum toward the upper end portion of the mover 920.

A weight 921 is provided in the upper end portion of the mover 920, and facilitates relative movement of the mover 920 from the supporter 910 by gravity when the lifter 900 is in the second section. The weight 921 may be coupled to the upper end portion of the mover 920, or may be embedded in the upper end portion of the mover 920. Alternatively, the weight 921 may not be provided in the mover 920.

A first shock reduction member 930 is provided in the lower end portion or bottom of the lifter 900 to be in contact with the inner circumferential surface of the drum when the lifter 900 has the first height. The first shock reduction member 930 absorbs a shock when the lower end portion of the mover 920 collides with the inner circumferential surface of the drum as the lifter 900 is changed from the second height to the first height. The first shock reduction member 930 may include various elastic materials, soundproofing materials, and shock absorbing materials.

A second shock reduction member 940 is provided in a region of the upper end portion of the supporter 910 to be in contact with the lower end portion of the mover 920 or in a region of the lower end portion of the mover 920 to be in contact with the upper end portion of the supporter 910, when the mover 920 moves to a position corresponding to the second height. In the accompanying drawings, the second shock reduction member 940 of the former case is shown. The second shock reduction member 940 absorbs a shock when the supporter 910 and the mover 920 collides with each other as the lifter 900 is changed to have the second height. The second shock reduction member 940 may include various elastic materials, soundproofing materials, and shock absorbing materials.

Figure 10:
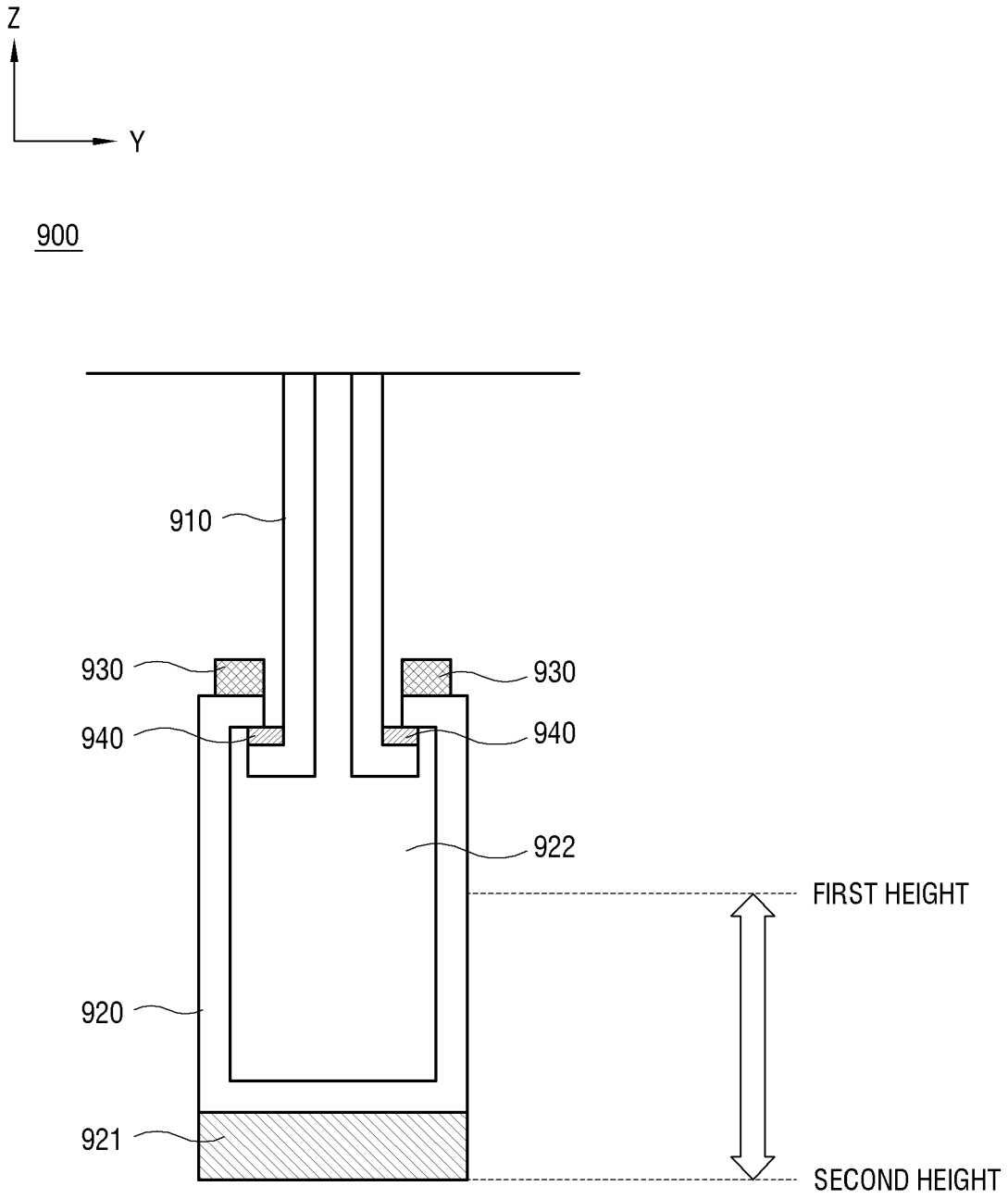
FIG. 10 is a lateral cross-section view of a lifter in a second state.

FIG. 10 is a lateral cross-section view of a lifter in a second state.

As shown in FIG. 10, when the lifter 900 enters the second section, the mover 920 moves in a direction away from the supporter 910 by gravity. The supporter 910 accommodated in the accommodating hole 922 is exposed to the outside as the mover 920 moves in a direction away from the inner circumferential surface of the drum. When the mover 920 moves up to a position corresponding to the second height, the upper end portion of the supporter 910 is caught in the entrance of the accommodating hole 922 and therefore the mover 920 is not completely separated from the supporter 910.

The second shock reduction member 940 absorbs a shock generated at the moment when the upper end portion of the supporter 910 is caught in the entrance of the accommodating hole 922.

Like this, the lifter 900 is stretched out from the first height to the second height in the second section, and therefore increased in an area to collide with the laundry lifted up by another lifters. When the lifter 900 enters the first section, the mover 920 retracts into the supporter 910 by the gravity, and the lifter 900 is shortened from the second height to the first height. When the lifter 900 is shortened from the second height to the first height, the first shock reduction member 930 absorbs a shock generated by the collision between the inner circumferential surface of the drum and the bottom of the mover 920.

Meanwhile, the foregoing embodiments show that the lifter alternates between the first height and the second height based on the rectilinear motion of the mover with respect to the supporter. However, the design for the variable height of the lifter is not limited to only the rectilinear motion of the mover. Alternatively, the mover may be embodied to have a rotary motion according to design methods, and thus such an embodiment will be described below.

Figure 11:
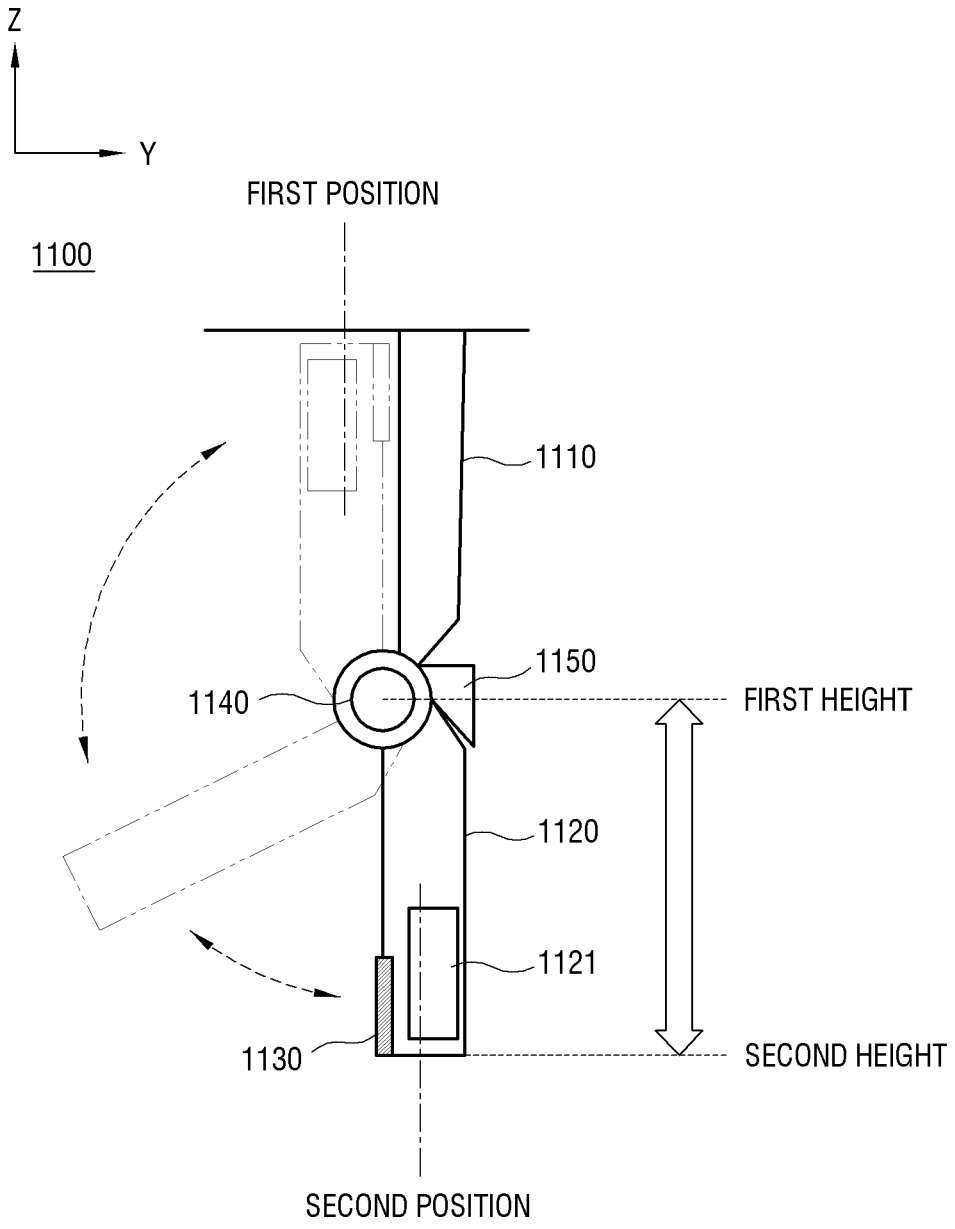
FIG. 11 is a lateral cross-section view of a lifter with a mover rotatable between a first position and a second position.

FIG. 11 is a lateral cross-section view of a lifter with a mover rotatable between a first position and a second position.

As shown in FIG. 11, a lifter 1100 includes a supporter 1110 fastened to the inner circumferential surface of the drum, and a mover 1120 rotatably supported on the supporter 1110. The upper end portion of the supporter 1110 includes a hinge 1140, and the hinge 1140 is coupled to the lower end portion of the mover 1120 so that the mover 1120 can have the rotary motion. In other words, the mover 1120 is pivotally provided on the supporter 1110 with respect to the hinge 1140.

The mover 1120 is provided to alternate between a first position where the upper end portion of the mover 1120 is folded toward the inner circumferential surface of the drum and a second position where the upper end portion of the mover 1120 is unfolded toward the spinning axis. The lifter 1100 has the first height when the mover 1120 is in the first position, and the second position when the mover 1120 is in the second position.

The lifter 1100 includes a weight 1121 provided in the upper end portion of the mover 1120 and facilitating the rotary motion of the mover 1120, a shock reduction member 1130 provided in a certain region of the mover 1120 to be in contact with the supporter 1110 when the lifter 1100 is changed from the second height to the first height, and a stopper 1150 preventing the mover 1120 pivoted from the first position to the second position from additional pivoting.

In general, the lifter 1100 is provided to be folded and unfolded around about the hinge 1140 to thereby have the first height when folded and the second height when unfolded. A direction in which the mover 1120 pivots from the first position to the second position, i.e. an unfolding direction of the lifter 1100 is opposite to the spinning direction of the drum. For example, when the drum spins clockwise, the mover 1120 is unfolded pivoting counterclockwise. Thus, the lifter 1100 is more easily unfolded.

When the lifter 1100 enters from the first section to the second section, the mover 1120 is unfolded from the first position by gravity while counterclockwise pivoting about the hinge 1140. When the mover 1120 reaches the second position, the mover 1120 cannot pivot counterclockwise any more because of the stopper 1150.

When the lifter 1100 enters from the second section to the first section, the mover 1120 is folded from the second position by gravity while clockwise pivoting about the hinge 1140. When the mover 1120 reaches the first position, the mover 1120 cannot pivot clockwise any more because of contact with the supporter 1110. The shock based on the collision between the mover 1120 and the supporter 1110 is absorbed by the shock reduction member 1130.

Meanwhile, the foregoing embodiments show that the method of changing the height of the lifter is based on gravity. However, the method of changing the height of the lifter is not necessarily limited to gravity, but may be embodied based on a separate driving structure. Below, such an embodiment will be described.

Figure 12:
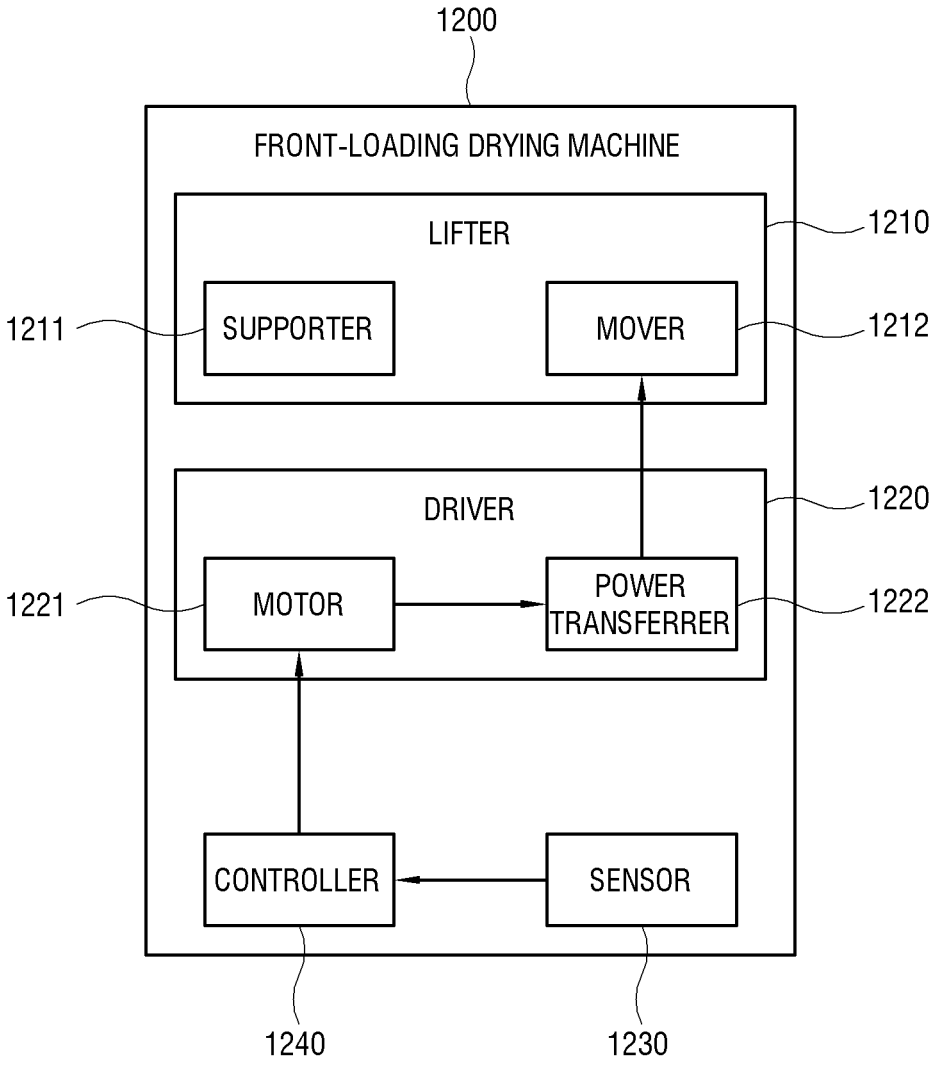
FIG. 12 is a block diagram of a front-loading drying machine including a lifter with a mover movable by a driver.

FIG. 12 is a block diagram of a front-loading drying machine including a lifter with a mover movable by a driver.

As shown in FIG. 12, a front-loading drying machine 1200 includes a lifter 1210, a driver 1220 for driving the lifter 1210, a sensor 1230 for detecting a relative position of the lifter 1210, and a controller 1240 for controlling operation of the driver 1220 based on detection results of the sensor 1230.

The lifter 1210 includes a supporter 1211 fastened to the inner circumferential surface of the drum, and a mover 1212 rotatably supported on the supporter 1211. The functions of the supporter 1211 and the mover 1212 are substantially the same as those of the foregoing embodiments, and therefore repetitive descriptions thereof will be avoided.

The driver 1220 includes a driver 1221 generating driving power, and a power transferrer 1222 transferring the driving power from the driver 1221 to the mover 1212. The power transferrer 1222 may have various structures as long as it can transfer as the driving power is connected to a rotary shaft of the driver 1221. For example, the power transferrer 1222 may include various kinds of gears and links.

The sensor 1230 detects which one of the first section and the second section the lifter 1210 is positioned in when the drum spins. For example, the sensor 1230 detects that the lifter 1210 is in the second section and notifies the controller 1240 of the detection. The sensor 1230 includes a photosensor to detect a specific position of the drum, and detects that the drum overtakes the specific position, thereby transmitting a detection signal to the controller 1240. Besides this example, the sensor 1230 may include various kinds of sensors.

The controller 1240 is embodied by a main board that includes circuits such as a central processing unit (CPU), a processor and a chipset to control the operation of the front-loading drying machine 1200. Alternatively, the controller 1240 may be embodied by the processor of the front-loading drying machine 1200. The controller 1240 controls the driver 1221 to move the mover 1212 to the position corresponding to the second height When it is identified that the lifter 1210 is in the second section based on the detection signal from the sensor 1230, and controls the driver 1221 to move the mover 1212 to the position corresponding to the first height when it is identified that the lifter 1210 is in the first section.

Thus, the front-loading drying machine 1200 identifies the position of the lifter 1210 based on the detection results of the sensor 1230, and control the height of the lifter 1210 with the driving power of the driver 1220 based on the identification results.

Meanwhile, the foregoing embodiments show that the structure of changing the height of the lifter is applied to the front-loading drying machine. However, this structure may be embodied to be applied to a front-loading washing machine as well as the front-loading drying machine. Below, such an embodiment will be described.

Figure 13:
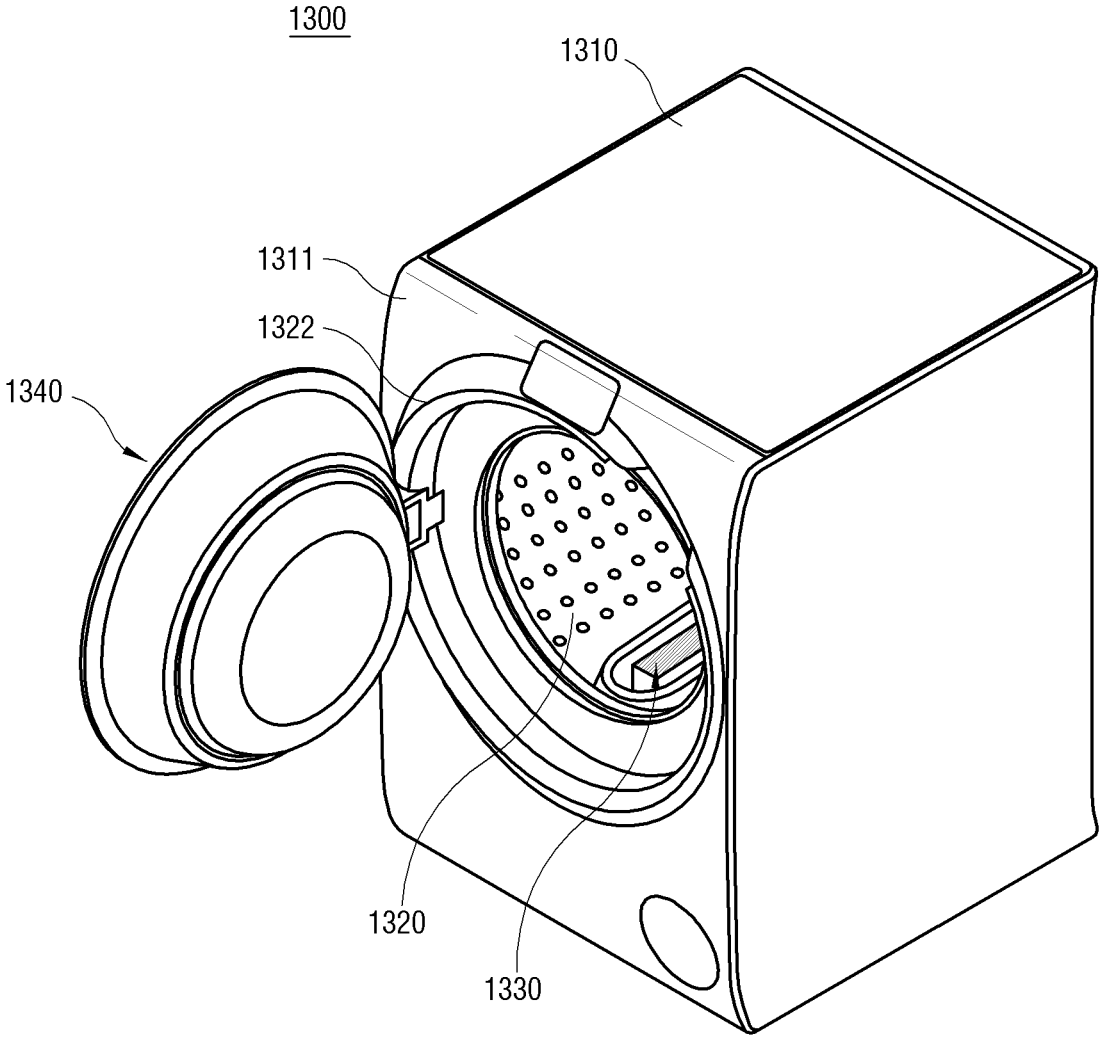
FIG. 13 is a perspective view of a front-loading washing machine.

FIG. 13 is a perspective view of a front-loading washing machine.

As shown in FIG. 13, a washing machine according to an embodiment of the disclosure is embodied by a front-loading washing machine 1300. The front-loading washing machine 1300 includes a washing tub 1320 spinning with respect to an axial line substantially parallel with an installation surface, unlike a top-loading washing machine including a washing tub spinning with respect to an axial line substantially perpendicular to the installation surface. However, the spinning axis of the washing tub 1320 is not necessarily horizontal, but may be inclined at a predetermined angle to the horizontal axis.

The front-loading washing machine 1300 includes a housing 1310 forming an outer appearance, the washing tub 1320 provided to spin inside the housing 1310, one or more lifters 1330 protruding from the inner circumferential surface of the washing tub 1320 toward the center axis of the washing tub 1320, and a door 1340 rotatably supported on a front panel 1311 and opening and closing an opening 1312 of the front panel 1311 of the housing 1310

In the front-loading washing machine 1300 according to this embodiment, the lifter 1330 is provided to have a first height in a first section and a second height higher than the first height in a second section while the washing tub 1320 is spinning. Such a structure of the lifter 1330 is equivalent to those of foregoing embodiments, and therefore repetitive descriptions thereof will be avoided.

The front-loading washing machine 1300 may allow the lifter 1330 to have a variable height or an invariable height according to its processes. For example, in a washing process of doing laundry with water, the laundry is cleaned by a shock of when the laundry is lifted up by the lifters 1330 and falls to collide with the inner circumferential surface of the washing tub 1320. In other words, the shock applied to the laundry is important in the washing process, and it is therefore preferable that the lifter 1330 keeps the first height without changing the height. On the other hand, a drying process of drying laundry after completely doing the laundry is substantially equivalent to the operations of the foregoing front-loading drying machine. Therefore, it is preferable in the drying process that the height of the lifter 1330 is switched over between the first height and the second height.

The front-loading washing machine 1300 identifies whether the current process is the drying process, and allows the height of the lifter 1330 to be variable when the current process is identified as the drying process but prevents the height of the lifter from being variable when the current process is not identified as the drying process. There may be various structures for selectively preventing the height of the lifter 1330 from being variable.

For example, the lifter may be provided with a blocking member to selectively block the movement of the mover. The blocking member may alternate between a blocking position for blocking the movement of the mover and an allowing position for allowing the movement of the mover. The blocking member is provided to be movable by a driver of the front-loading washing machine 1300, and the operation of the driver is controlled by the processor or controller of the front-loading washing machine 1300.

Although a few embodiments have been shown and described, it will be appreciated by those skilled in the art that changes may be made in these embodiments without departing from the principles and spirit of the invention, the scope of which is defined in the appended claims and their equivalents.

What is claimed is:

1. A front-loading laundry-washing apparatus comprising:

a housing comprising a door, in a front of the housing, that opens and closes;

a washing tub rotatably supported inside the housing and shaped like a cylinder opened toward the door so that laundry is loadable in the washing tub when the door is opened; and a plurality of lifters arranged at predetermined intervals along a spinning direction of the washing tub on an inner circumferential surface of the washing tub, and each lifter of the plurality of lifters includes an end portion extended toward a spinning axis of the washing tub, wherein at least one lifter of the plurality of lifters is provided to alternate between a first state in which the lifter has a first height from the inner circumferential surface in a first section within a spinning section of the washing tub and a second state in which the lifter has a second height higher than the first height from the inner circumferential surface in a second section within the spinning section of the washing tub, wherein the at least one lifter comprises:

a supporter coupled to the inner circumferential surface of the washing tub, a mover movably supported by the supporter to alternate between the first state and the second state of the at least one lifter, and wherein a first end portion of the mover faces the spinning axis of the washing tub and a second end portion of the mover faces the inner circumferential surface of the washing tub, and a weight disposed in the first end portion of the mover to assist with movement of the mover based on gravity, wherein the mover comprises a main body and the weight comprises a heavier material than the main body.

2. The front-loading laundry-washing apparatus according to claim 1, wherein the first section and the second section are symmetrical to each other with respect to the spinning axis of the washing tub.

3. The front-loading laundry-washing apparatus according to claim 2, wherein the second section starts before the at least one lifter reaches a highest position in a gravity direction, and the first section starts before the at least one lifter reaches a lowest position in the gravity direction.

4. The front-loading laundry-washing apparatus according to claim 1, wherein the supporter comprises a hole therein, and the mover is movable as inserted in the hole of the supporter.

5. The front-loading laundry-washing apparatus according to claim 4, wherein a lateral side of the hole is formed with a plurality of guides spaced apart from each other along a spinning axis direction of the washing tub and guiding the mover to move while being in contact with an outer surface of the mover.

6. The front-loading laundry-washing apparatus according to claim 5, wherein a distance between two guides of the plurality of guides facing each other to form the hole in an upper end portion of the hole is smaller than a width of the second end portion of the mover.

7. The front-loading laundry-washing apparatus according to claim 1, wherein the second end portion of the mover is configured to be wider than the first end portion of the mover measured along the spinning direction of the washing tub.

8. The front-loading laundry-washing apparatus according to claim 1, wherein each lifter of the at least one lifter further comprises a shock reduction member provided at a side opposite to the second end portion of the mover and comprises an elastic material.

9. The front-loading laundry-washing apparatus according to claim 1, further comprising:

at least one driver to move the mover of each lifter of the at least one lifter, and a controller to control the at least one driver to move the mover of each lifter of the at least one lifter to alternate between the first state and the second state.

10. The front-loading laundry-washing apparatus according to claim 1, wherein the second height is 20% to 40% of a diameter of the washing tub.

11. The front-loading laundry-washing apparatus according to claim 1, wherein the second height is twice the first height.

12. A front-loading laundry-washing apparatus comprising:

a housing comprising a door, in a front of the housing, that opens and closes;

a washing tub rotatably supported inside the housing and shaped like a cylinder opened toward the door so that laundry is loadable in the washing tub when the door is opened; and a plurality of lifters arranged at predetermined intervals along a spinning direction of the washing tub on an inner circumferential surface of the washing tub, and each lifter of the plurality of lifters includes an end portion extended toward a spinning axis of the washing tub, wherein at least one lifter of the plurality of lifters is provided to alternate between a first state in which the lifter has a first height from the inner circumferential surface in a first section within a spinning section of the washing tub and a second state in which the lifter has a second height higher than the first height from the inner circumferential surface in a second section within the spinning section of the washing tub, wherein the at least one lifter comprises:

a supporter coupled to the inner circumferential surface of the washing tub, and a mover movably supported by the supporter to alternate between the first state and the second state of the at least one lifter, and wherein a first end portion of the mover faces a rotating axis of the washing tub and a second end portion of the mover faces the inner circumferential surface of the washing tub, wherein an empty space is in the second end portion to reduce weight in the second end portion to assist with movement of the mover based on gravity.

* * * * *